US005863260A

United States Patent [19]

Butler, Jr. et al.

[11] Patent Number: 5,863,260

[45] Date of Patent: Jan. 26, 1999

[54] DEVICE-COUPLED ASSEMBLY AND DEVICE USED THEREWITH

[76] Inventors: Joseph H. Butler, Jr., 3526 Shea Rd., Memphis, Tenn. 38017; Michael W. Hedrick, 3771 Kearney, Memphis, Tenn. 38111; Michael R. McCaskey, 487 Western Dr., Memphis, Tenn. 38122

[21] Appl. No.: 873,098

[22] Filed: Jun. 11, 1997

Related U.S. Application Data

[63] Continuation of Ser. No. 502,721, Jul. 14, 1995, abandoned.

[51] Int. Cl.[6] ..... H63B 53/02

[52] U.S. Cl. ..... 473/305; 473/324; 473/287; 473/289

[58] Field of Search ..... 473/324, 305, 473/204, 300, 301, 302, 303, 314, 287–291, 282; 403/306, 342, 299, 289, 287, 300, 145; 15/145

[56] References Cited

U.S. PATENT DOCUMENTS

| | | | |
|---|---|---|---|
| D. 359,541 | 6/1995 | Lamanna | 473/305 |
| 1,553,867 | 9/1925 | Maas | 473/305 |
| 1,565,070 | 12/1925 | Edwards | 473/305 |
| 1,601,770 | 10/1926 | Reach | 473/305 |
| 1,650,183 | 11/1927 | Brooks | 473/305 |
| 1,818,553 | 8/1931 | Hadden | 473/305 |
| 1,916,791 | 7/1933 | Hadden | 473/305 |
| 2,129,068 | 9/1938 | Reach | 473/305 |
| 2,203,893 | 6/1940 | Chapman | 473/305 |
| 2,225,931 | 12/1940 | Sexton | 473/305 |
| 2,315,792 | 4/1943 | Hoss | 473/305 |
| 2,361,415 | 10/1944 | Reach | 473/305 |
| 2,363,991 | 11/1944 | Reach | 473/305 |
| 2,463,053 | 3/1949 | Pritchard | 473/305 |
| 2,874,938 | 2/1959 | Higgins | 473/305 |
| 3,170,691 | 2/1965 | Pritchard | 473/305 |
| 3,682,516 | 8/1972 | Savage | 306/30 |
| 3,825,991 | 7/1974 | Cornell | 473/305 |
| 3,848,737 | 11/1974 | Kenon | 473/305 |
| 3,907,446 | 9/1975 | Leslie | 473/305 |
| 4,003,668 | 1/1977 | Kelly, III et al. | 403/287 |
| 4,340,227 | 7/1982 | Dopkowski | 473/305 |
| 4,655,457 | 4/1987 | Thompson | 473/305 |
| 4,852,785 | 8/1989 | Wu | 473/305 |
| 4,854,582 | 8/1989 | Yamada | 473/305 |
| 4,895,368 | 1/1990 | Geiger | 473/305 |
| 4,948,132 | 8/1990 | Wharton | 473/305 |
| 5,039,098 | 8/1991 | Pelz | 473/305 |
| 5,184,819 | 2/1993 | Desbiolles | 473/305 |
| 5,335,909 | 8/1994 | Green, Jr. | 273/80.2 |
| 5,385,420 | 1/1995 | Newman, Sr. et al. | 403/299 |
| 5,426,130 | 6/1995 | Thurber et al. | 473/305 |
| 5,454,563 | 10/1995 | Nagamoto et al. | 473/305 |
| 5,462,279 | 10/1995 | Culpepper | 473/305 |
| 5,513,844 | 5/1996 | Ashcraft et al. | 473/305 |
| 5,533,725 | 7/1996 | Reynolds, Jr. | 473/305 |

FOREIGN PATENT DOCUMENTS

| | | | |
|---|---|---|---|
| 0 450 963 A1 | 4/1991 | European Pat. Off. | 473/305 |
| 0 588 560 A2 | 3/1994 | European Pat. Off. | 473/305 |
| 443439 | 3/1936 | United Kingdom . | |
| WO 94/11427 | 5/1994 | WIPO . | |

*Primary Examiner*—John G. Weiss
*Assistant Examiner*—Charles W. Anderson
*Attorney, Agent, or Firm*—Edward D. Murphy

[57] ABSTRACT

A device-coupled golf club 80 includes a club head 64 which is assembled with a shaft 22 by use of a coupling device 40. Club head 64 is formed with a hosel 68 which is formed with a bore 70 having threads 76 formed in an upper portion thereof and a floor 74 at the base thereof. Coupling device 40 is formed with a body 41 having a bore 42 formed axially therethrough. A flange 44 is formed radially outwardly from one end of the body 41 and is formed with threads 50 from the flange toward the opposite axial end of the body. A ferrule 56 is located on shaft 22 and a tip end 30 of the shaft is inserted into bore 42 of body 41 and secured there by an epoxy glue 82. An exterior surface of body 41 is formed with threads 50 which engage threads 76 formed within bore 70 of hosel 68 to removably secure device 40 with head 64 whereby shaft 22 is assembled with the head 64 to form club 80.

14 Claims, 3 Drawing Sheets

DEVICE-COUPLED ASSEMBLY AND DEVICE USED THEREWITH

This is a Continuation of application Ser. No. 08/502,721 filed Jul. 14, 1995, now abandoned.

BACKGROUND OF THE INVENTION

This invention relates to a device-coupled assembly and to a device used therewith and particularly relates to a golf club formed by a shaft which is coupled to a golf club head through a coupling device and further relates to the coupling device.

Golf clubs are typically formed by a shaft which is coupled to a club head. The shaft is formed with a relatively large width or diameter at one end, referred to as the butt end, and a relatively small width or diameter at the opposite end, which is referred to as the tip end. The shaft is typically tapered uniformly from the butt end to the tip end and may be formed with a short cylindrical length at the tip end. The shaft could be formed in other configurations if desired. A hollow stem, commonly referred to as the hosel, is formed with and extends outwardly from the head. The hollowed portion, or opening, of the hosel typically conforms to the shape and size of the exterior of the shaft at the tip end thereof to facilitate assembly of the tip end of the shaft within the hosel. For example, the hosel could be cylindrical for receipt of the short cylindrical length of the tip end of the shaft.

Currently, in one technique for manufacturing golf clubs, the tip end of the shaft is coated with a bonding agent such as an epoxy glue and is then placed into the opening of the hosel. Thereafter the epoxy glue cures to provide a permanent bond between the tip end of the shaft and the hosel to thereby join the shaft to the club head to form the golf club. With such a bonded arrangement between the shaft and the hosel, it is impossible to reverse the assembly without destruction of either, or both, the tip end of the shaft and the hosel of the head. From a practical standpoint, this eliminates the opportunity for the user of such clubs to remove the shaft from assembly with the head.

The ability to uncouple the shaft from the head may be desirable for a variety reasons. For example, the shaft or head of a currently used club may be damaged or worn and the user may wish to keep the component which is not worn or damaged and replace the other component. Also, it may be desirable to transport and or store the shaft independently of the head when the club is not in use in a manner similar to the dismantling of a pool cue stick for the same purpose. Further, there are numerous fitting shops where a golfer can practice and experiment with a number of different golf clubs to determine which club is most suitable for the golfer. In such a practice and experimenting environment, it would be most practical if the golfer could assemble selected shafts with selected heads on an interchangeable basis to locate the optimum combination of shaft and head to further enhance the golfer's playing of the game of golf.

While many coupling devices have been designed over the years for coupling a shaft to a club head, some of these devices are interposed axially between the shaft and the hosel. Thus, such a device forms a portion of the length of the club and presents a potentially weak link in the area of the coupling device. Also, with such a device, there are no laterally overlapping portions of the shaft and hosel which would tend to provide necessary lateral strength when the club is swung to hit a golf ball.

A few coupling devices of past design do allow the tip end of the shaft and the head or hosel to be in lateral alignment.

Typically though, devices of this type undesirably add bulk to the club compared to an unaltered club.

Devices of the types noted above, add mass, weight and length to critical areas of a club thereby creating an imbalance in the parameters of the club which could undesirably affect the golfer's swing and impact with the ball.

Thus, there is a need for a device for removably coupling one object, such as a golf club shaft, to another object, such as a golf club head or hosel of the head. There is a further need for such a device where, when comparing the device-coupled club with a directly coupled shaft and head, the presence of the device does not alter the mass of the head and the swing weight and the natural frequency of the club. Further, there is a need for such a device for use in forming a club where, in comparison with the directly coupled club, the mass and the total length of the club remain unchanged by the addition of the device and the length of the tip end of the shaft which is inserted into the head and/or the hosel is the same as the directly coupled club.

SUMMARY OF THE INVENTION

In view of the foregoing needs, it is an object of this invention to provide a simple and inexpensive device for coupling one object to another object without affecting various critical parameters of the coupled objects had they been coupled directly.

It is another object of this invention to provide a device for removably coupling one abject to another object.

Still another object of this invention is to provide a device for coupling a shaft to a golf club head to form a golf club which, when comparing the device-coupled club with a club having the shaft coupled directly to the head, does not alter the mass of the head and the swing weight and natural frequency of the club.

A further object of this invention is to provide a device to form a device-coupled golf club which, when compared to a club formed by a directly coupled shaft and head, results in a club wherein the mass and the total length of the club remain unchanged.

Yet another object of this invention is to provide a golf club wherein the shaft and the club head are coupled through an intermediate device which facilitates removable coupling of the shaft to the head.

With these and other objects in mind, this invention contemplates an assembly including a first object and a second object coupled through a device to the first object. The first object is formed with an opening of a first prescribed shape, radial size and length and is formed with a fastening structure at least within a portion thereof adjacent a mouth of the opening. The second object is formed with an exterior structure at one portion thereof with a second prescribed shape, radial size and length which is to be coupled with the first object. The device comprises a body having a external flange with a radial size greater than the first prescribed radial size. An external section of the device is formed intregally with and extends axially of the body from the flange thereof and has an external shape, radial size and length generally similar to the first prescribed shape, radial size and length. The body is formed with a bore with a shape, radial size and length generally similar to the second prescribed shape, radial size and length. The bore of the body is formed with a first end which is open and extends to a second end thereof. The external section of the body is formed with a fastening structure which extends along the external section at least from a juncture of the flange and the external section. The fastening structure of the body is of a type which cooperates with the fastening structure of the first object to facilitate the removable assembly and coupling of the body with the first object. The exterior structure of the second object is located within the bore of the body and extends along the length of the bore from the first end to the second end thereof and is bonded irremovably to the body.

This invention further contemplates a device for coupling two objects together and comprises a body having an external flange and an exterior section integral with and extending axially from the flange. A fastening structure of a removable type is formed on at least a portion of the external section of the body and extends from a juncture of the flange and the exterior section thereof. The body is formed with a bore having a first end which is open adjacent the flange and which extends to a second end thereof.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
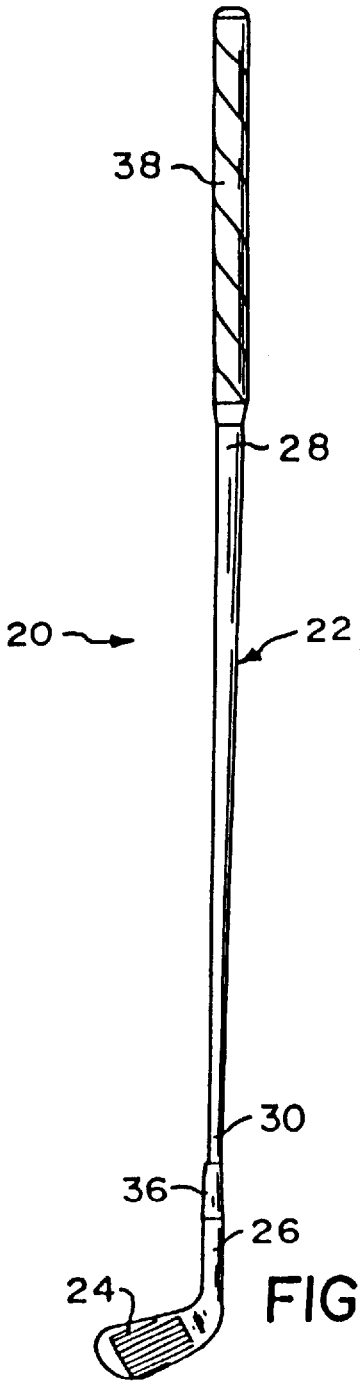
FIG. 1 is a side view of a prior golf club showing the basic elements thereof.

Referring to FIG. 1, a golf club 20 includes a shaft 22 and a club head 24. A hosel 26 is formed with and extends generally upwardly from the club head 24. Shaft 22 is typically tapered inwardly from a butt end 28 at the top thereof to a location at or near a tip end 30 at the bottom thereof. If the taper extends to the very end of the tip end 30, the shaft 22 is referred to as a tapered tip shaft. If the taper extends to a location near the very end of the tip end 30, and is generally cylindrical for the remainder of the length of the shaft 22 to the very end, the shaft is referred to as a parallel tip shaft.

Figure 2:
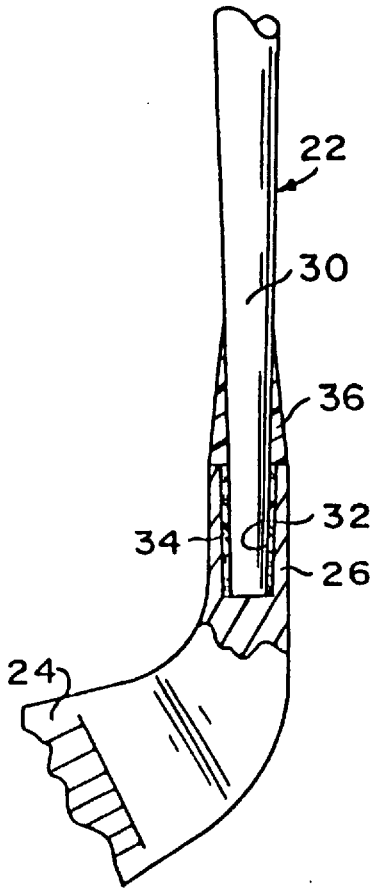
FIG. 2 is a partial side view of the prior golf club of FIG. 1 showing a prior technique of coupling a shaft to a golf club head.

Hosel 26 is formed with a bore 32 as shown in FIG. 2 for receipt of the tip end 30 of shaft 22. Typically, some form of securing means is utilized to permanently secure tip end 30 within the bore of hosel 26. One example of such a securing means is an epoxy glue 34 which is placed about the tip end 30 and within the bore of the hosel 26 before the tip end is inserted into the bore. After insertion, the glue 34 cures and provides the desired bond to permanently retain the shaft 22 with the hosel 30 and thereby with the head 24. A ferrule 36 may be placed about the shaft 22 near the tip end 30 and adjacent the hosel 26. Further, a grip 38 is typically placed about the butt end 28.

On occasion, it may be desirable to be able to dismantle the shaft 22 from the head 24. For example, the shaft 22 or the head 24 may be damaged or worn and the user may wish to replace the worn or damaged component. Also, one may wish to dismantle the shaft 22 from the head 24 to facilitate transport and/or storage of the components in the manner typically associated with the dismantling of a pool cue stick. Further, there are many fitting shops where a golfer can practice with a variety of clubs to determine which club is best suited for the golfer. It would be desirable if the golfer could "mix and match" various club heads with various shafts to determine the best combination of shaft and head for the golfer.

While the foregoing reasons for dismantling the shaft 22 from the head 24 are laudable and desirable, if the shaft 22 has been assembled permanently with the hosel 26 by use of the epoxy glue 34, such as illustrated in FIG. 1, there is no opportunity to dismantle the shaft from the hosel and the head.

Figure 3:
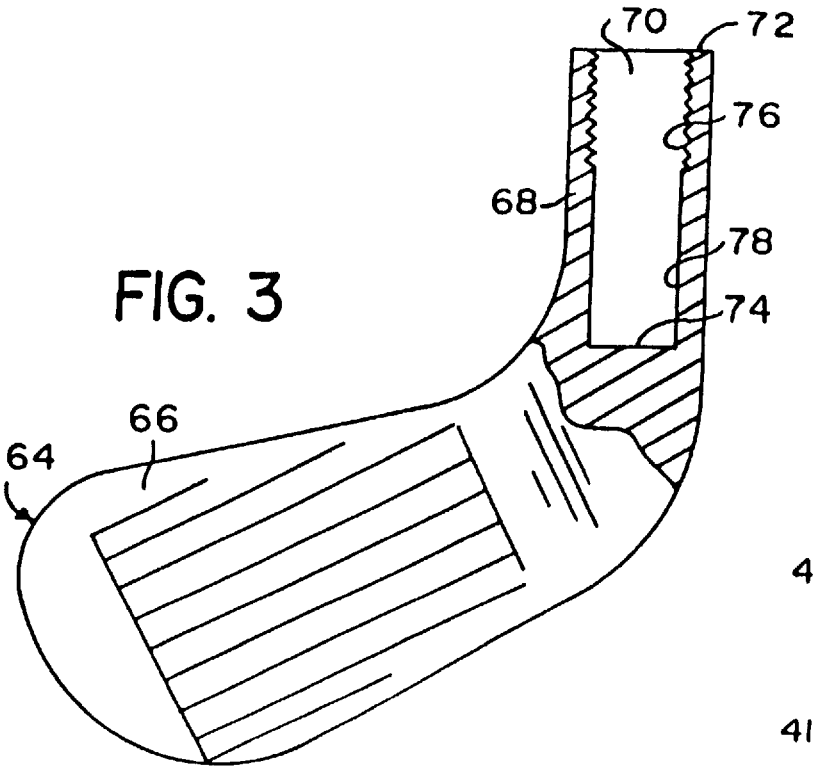
FIG. 3 is a side view of a golf club head with portions broken away showing structural features in accordance with certain principles of the invention.
Figure 4:
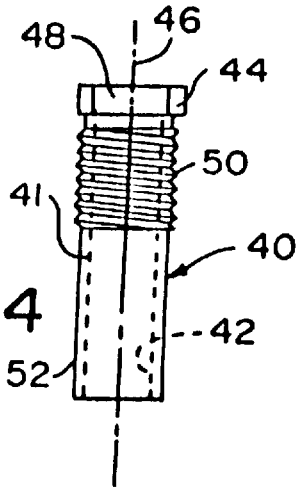
FIG. 4 is a side view of a coupling device embodying certain, principles of the invention for coupling together a shaft and the golf club head of FIG. 3.

Referring to FIG. 4, a device 40 is structured for assembly with a first object such as a golf club head 64 (FIG. 3), and with a second object such as shaft 22 (FIG. 2). The use of device 40 facilitates the assembly and disassembly of the head 64 and the shaft 22 in an efficient manner.

Figure 5:
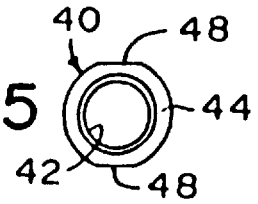
FIG. 5 is a top view of the coupling device of FIG. 4.
Figure 7:
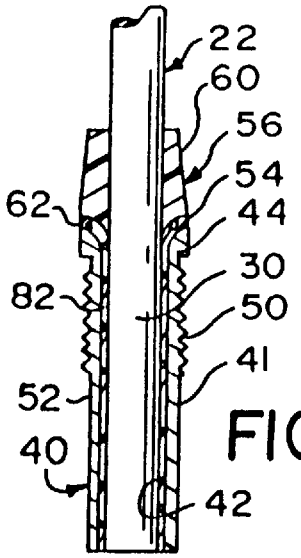
FIG. 7 is a sectional view showing a shaft in bonded assembly with the coupling device of FIG. 4 in accordance with certain principles of the invention.
Figure 8:
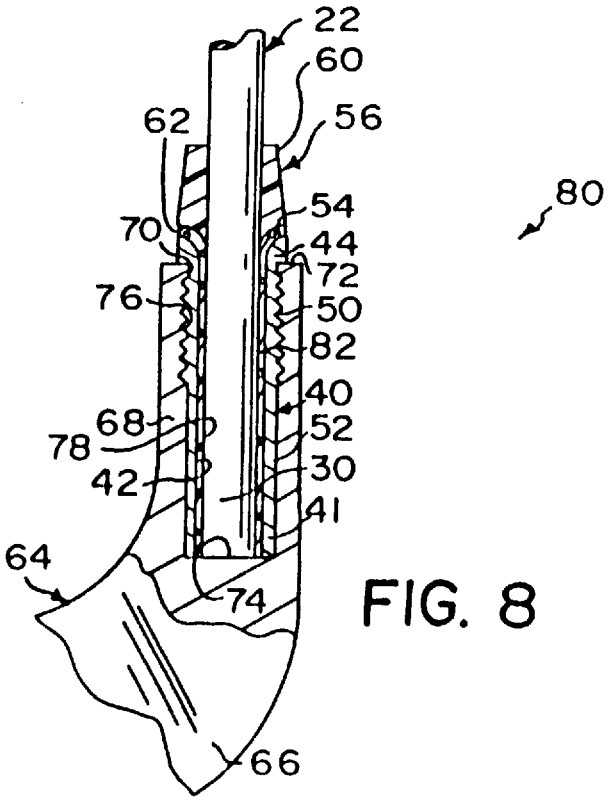
FIG. 8 is a sectional view of the shaft of FIG. 7 in assembly with a golf club head by use of the coupling device of FIG. 4 in accordance with certain principles of the invention.

Device 40 is formed with a generally cylindrical body 41 having a bore 42 formed therethrough. A flange 44 is formed at a flange end of the body 41 of the device 40 and extends radially outwardly from an axis 46 of the device. A pair of flat surfaces 48 (FIG. 5) are formed on opposite sides of the periphery of the flange 44. Threads 50, which forms a fastening structure, are formed on a portion of the outer or external surface of the body 41 of the device 40 and extend from the flange 44 toward the other end, opposite the flange end, of the device. In the preferred embodiment, the threads 50 extend toward the other end of the device 40, opposite the flange end, for a distance which is less than one-half the length of the device. A surface 52, which is smooth, extends from the inboard end of the threads to the other end of the device. The mouth of the bore 42 at the flange end is formed with a chamfered surface 54 as illustrated in FIGS. 7 and 8.

It is noted that the threads 50 could extend farther along the device 40 toward, or continue to, the other end of the device 40 without departing from the spirit and scope of certain aspects of the invention. In addition, the bore 42 extends axially through the device 40 but could be formed with a closed floor at the other end thereof without departing from the spirit and scope of certain aspects of the invention.

Figure 6:
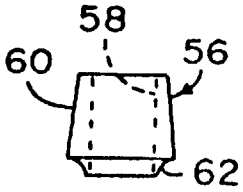
FIG. 6 is a side view of a ferrule for assembly on a shaft in the formation of a golf club in accordance with certain principles of the invention.

As shown in FIG. 6, a ferrule 56 is formed with a bore 58 therethrough, an outwardly tapered outer surface 60 from the top to near the bottom thereof and a slight radiused undercut surface 62 at the bottom outer portion thereof.

Referring to FIG. 3, the golf club head 64 includes a body portion 66 and a hosel 68 extending integrally and generally upwardly from the body. A bore 70 is formed in an upper end 72 of the hosel 68 and extends to a prescribed depth as defined by a floor 74 of the bore. Threads 76, which forms a fastening structure, are formed in a portion of the bore wall and extend from the mouth of the bore adjacent upper end 72 of the hosel 68 toward the floor 74 of the bore. The pitch of the threads 76 of the bore 70 match the pitch of the threads 50 of the device 40.

In the preferred embodiment, the threads 76 extend a distance into bore 70 which is less than one-half the total length of the bore whereby the remainder of the bore wall is formed with a smooth surface 78. However, the threads 76 could extend farther into, or to the floor 74 of, the bore 70 without departing from the spirit and scope of certain aspects of the invention.

Referring to FIG. 7, shaft 22 is a parallel tip shaft and is formed with a cylindrical tip end 30 having an outside diameter slightly less than the diameter of the bore 42 of the device 40. When assembling the components of a golf club 80 (FIG. 8) which includes the device 40, the ferrule 56 is placed onto the shaft 22 at the tip end 30 and moved axially over the shaft toward the butt end 28. An epoxy glue in liquid form is deposited onto the cylindrical tip end 30 of the shaft 22 and into the bore 42 of the device 40. Thereafter, the glue-coated cylindrical tip end 30 of the shaft 22 is inserted into the bore 42 of the device 40 and the bottom of the shaft is aligned with the bottom of the bore as illustrated in FIG. 7. It is noted that the tip end 30 of the shaft 22 could be a parallel tip shaft or a tapered tip shaft and the bore 42 of the device 40 would be of complementary shape to accommodate either type of shaft without departing from the spirit and scope of the invention.

As the tip end 30 is moved into position in the bore 42, the epoxy glue locates within a space defined by the outer surface of the tip end and the wall of the bore whereby some of the glue flows onto the chamfered surface 54 of the device 40. The ferrule 56 is then moved axially over the shaft 22 toward the device 40 until the radiused surface 62 of the ferrule is located adjacent the chamfered surface 54 and engages the portion of the epoxy glue which is located on the chamfered surface. The epoxy glue then cures as a solidified epoxy glue 82 (FIGS. 7 and 8) to form a permanent bond and thereby hold and secure the cylindrical tip end 30, the device 40 and the ferrule 56 in the assembled relation as shown in FIG. 7. Even though there is sufficient space for the cured epoxy glue 82 between the wall surface of bore 42 of the device 40 and the adjacent peripheral surface of tip end 30 of the shaft 22, the wall surface and the peripheral surface engage sufficiently for a tight fit independently of the epoxy glue. This tight fit further enhances the bonding and securing of the shaft 22 with the device 40.

Thereafter, the assembly of the shaft 22 and the device 40 are manipulated to insert the end of the device adjacent the smooth surface 52 into the bore 70 of the hosel 68. The portion of the device 40 which forms the smooth surface 52 serves as a guide to insure that the device is properly aligned with the hosel 68 as the threads 50 of the device begin to engage the threads 76 of the hosel thereby preventing cross threading during assembly. Thus, it is important that the threads 50 of the device 40 be located on the device in such a position to allow the device to be guided into the bore 42 before the threads 50 and 76 begin to threadedly engage. Therefore, in the preferred embodiment, a portion of the device 40 includes the smooth surface 52 extending from the threads 50 toward the bottom or other end of the device.

Eventually, the device 40 is located in the bore 70 of the hosel 68 until the flange 44 engages the upper end of the hosel to preclude any farther movement into the bore. At this location, the bottom of the device 40 and the shaft 22 are adjacent the floor 74 of the bore 70 of the hosel 68. This places the cylindrical tip end 30 of the shaft 22 in a depth location within the bore 70 of the hosel 68 which is essentially identical to the depth location that shaft 22 assumes within the head 24 (FIGS. 1 and 2) where the tip end is bonded directly to the hosel. Thus, the lateral strength provided by the locating of the tip end 30 fully within the hosel 68 remains essentially the same as when the tip end is assembled within hosel 26. This is accomplished by forming the bore 42 of the device 40 fully axially through the device to thereby allow the very bottom end of the tip end 30 of the shaft 22 to be located at the floor 74 of the bore 70 of the hosel 68. In addition, the total length of the club 80 remains the same as the prior club 20 because the bottom of the shaft 22 is located on the floor 74 of the bore 70 of the hosel 68 in the same manner as in the club 20. The assembly of golf club 80 is now complete.

If the golfer is right handed, the threads 50 and 76 are left-hand threads and they are right-hand threads if the golfer is left handed. In this manner, as the golfer strikes a ball, the impact tends to tighten the head 64 onto the device 40 thereby insuring that the club head is not loosened. To further enhance the securance of the head 64 with the shaft 22, a lock/sealing solution can be applied to the threads 50 and 76 prior to assembly. The solution forms a locking seal which can be broken by exerting a reverse twist on the device 40 relative to the head 64 such as by turning a wrench which has been placed over the flats 48 of the flange 44. A lock/sealing solution of this type is available from ND Industries of Troy, Mich., under their trademark VIBRA-TITE.

Smooth surface 52 of the device 40 is milled with a small tolerance so that there is a tight fit within the bore 70 of the hosel 64. Further, the threads 50 and 76 provide additional friction gripping surfaces to enhance the retention of the device 40 with the hosel 68.

The device 40 is made from 17-4 pH stainless steel and the head 64, including the hosel 68, is made from 416 stainless steel. By using different types of stainless steel, galling between the device 40 and the hosel 68 is prevented. Also, the device 40 is extremely thin and is, therefore, lightweight. For this reason, the addition of the device 40 to the assembly of the golf club 80 has essentially no effect on various parameters of the club when compared to the manner of assembly accomplished in club 20.

In effect, when the club 80, as assembled by use of the device 40, is compared with the club 20, the head mass, the swing weight and the normal frequency is unaltered while the total mass and total length of the club remain the same. The club 80 can be dismantled for the variety of reasons noted above and maintain performance parameters when the club is assembled, which parameters are essentially the same as a club, such as the club 20, which cannot be dismantled. Thus, the use of the device 40 does not affect adversely the performance of the club 80.

In general, the above-identified embodiments are not to be construed as limiting the breadth of the present invention. Modifications, and other alternative constructions, will be apparent which are within the spirit and scope of the invention as defined in the appended claims.

What is claimed is:

1. A golf club assembly, which comprises:

a shaft having a tip end formed along a tip axis with a prescribed configuration, a club head formed with a bore having an outboard insert end and an inboard floor end between which the bore extends;

a coupler formed with an opening extending inward from a tip-insert end thereof to an internal opposite end thereof and with a configuration complementary to the prescribed configuration of the shaft tip end for receipt of the tip end therein to form a shaft/coupler subassembly;

means for securing the tip end of the shaft within the opening of the coupler;

the coupler formed with an external surface which extends from the tip-insert end thereof to an external opposite end thereof;

a first section of the external surface of the coupler extending between the tip-insert end to a coupler intermediate portion thereof and formed with a coupler fastening structure;

a second section of the external surface of the coupler extending between the coupler intermediate portion to the external opposite end thereof and formed with a prescribed surface structure dissimilar from the coupler fastening structure;

the bore of the club head being formed with a first section which extends from the shaft-insert end to a bore intermediate portion thereof and which is formed with a head fastening structure complementary to the coupler fastening structure;

the bore of the club head being formed with a second section which extends from the bore intermediate portion to the inboard floor end thereof and which is formed with a structure and size complementary to, and for receipt therein of, the prescribed surface structure of the second section of the external surface of the coupler; and the coupler fastening structure and the head fastening structure being of the type which facilitates selective assembly and disassembly of the club head with the shaft/coupler subassembly.

2. The golf club assembly as set forth in claim 1, which further comprises:

the coupler and the bore of the club head each being formed with a prescribed axial length to allow the external opposite end of the coupler to seat on the inboard floor end of the bore when the coupler is assembled with the club head.

3. The golf club assembly as set forth in claim 2, which further comprises:

the opening of the coupler being formed from the insert end through the internal opposite end thereof to allow the tip end of the shaft to be positioned adjacent the inboard floor end of the bore of the club head.

4. The golf club assembly as set forth in claim 1, which further comprises:

a lateral surface formed on the club head laterally and outwardly in a plane including the outboard insert end of the bore; and a flange formed laterally and outwardly on the coupler adjacent the tip-insert end of the opening of the coupler where, upon assembly of the coupler with the club head, the flange is located adjacent the lateral surface of the club head.

5. The golf club assembly as set forth in claim 1, which further comprises a bonding agent located between the tip of the shaft and the opening of the coupler to secure the shaft and the coupler together.

6. A golf club assembly, which comprises:

a shaft having a tip formed along a tip axis with an outboard end formed on the tip and with the tip formed in a prescribed configuration;

a club head formed with a bore having an outboard insert end and an inboard floor end between which the bore extends;

a coupler formed with a through passage extending inward from a tip-insert end opening thereof through an internal opposite end opening thereof and with a configuration complementary to the prescribed configuration of the tip of the shaft for receipt of the tip therein with the outboard end of the tip being adjacent the internal opposite end of the coupler to form a shaft/coupler subassembly;

the opening at the internal opposite end of the coupler being adjacent, and open to, the inboard floor end of the club head;

means for securing the tip of the shaft within the opening of the coupler;

the coupler formed with an external surface which extends from the tip-insert end thereof to an external opposite end thereof and formed with a coupler fastening structure on at least a portion thereof; and the bore of the club head being formed on at least a portion thereof with a fastening structure complementary to the coupler fastening structure for fastening receipt of the external surface of the coupler therein.

7. The golf club assembly as set forth in claim 6, which further comprises:

the coupler and the bore of the club head each being formed with a prescribed axial length to allow the external opposite end of the coupler to seat on the inboard floor end of the bore when the coupler is assembled with the club head.

8. The golf club assembly as set forth in claim 7, which further comprises:

the opening of the coupler being formed from the tip-insert end through the internal opposite end thereof to allow the tip end of the shaft to be positioned adjacent the inboard floor end of the bore of the club head.

9. The golf club assembly as set forth in claim 6, which further comprises:

a lateral surface formed on the club head laterally and outwardly in a plane including the outboard insert end of the bore; and a flange formed laterally and outwardly on the coupler adjacent the tip-insert end of the opening of the coupler where, upon assembly of the coupler with the club head, the flange is located adjacent the lateral surface of the club head.

10. The golf club assembly as set forth in claim 6, which further comprises a bonding agent located between the tip of the shaft and the opening of the coupler to secure the shaft and the coupler together.

11. A coupler for use in a golf club assembly wherein the golf club assembly includes a shaft having a tip end formed along a tip axis with a prescribed configuration, and a club head formed with a bore having an outboard insert end and an inboard floor end between which the bore extends, the bore of the club head being formed with a first section which extends from the outboard insert end to a bore intermediate portion thereof and which is formed with a fastening structure, and the bore of the club head being formed. with a second section which extends from the bore intermediate portion to the opposite end thereof and which is formed with a prescribed structure which is dissimilar from the fastening structure of the first section, which comprises:

a body formed with an opening extending inward from a tip-insert end thereof to an internal opposite end thereof and with a configuration complementary to the prescribed configuration of the tip end of the shaft for receipt of the tip end in the opening;

the body formed with an external surface which extends from the tip-insert end thereof to an external opposite end thereof;

a first section of the external surface of the body extending between the tip-insert end to a body intermediate portion thereof and formed with a fastening structure complementary to the fastening structure of the bore of the club head; and a second section of the external surface of the body extending between the body intermediate portion to the external opposite end thereof and formed with a surface structure dissimilar from the fastening structure of the body and complementary to the prescribed structure of the second section of the bore of the club head.

12. The coupler as set forth in claim 11 wherein the bore of the club head is formed with a prescribed axial length, which further comprises:

the body being formed with an axial length substantially equal to the prescribed axial length of the bore of the club head.

13. The coupler as set forth in claim 11, which further comprises:

the opening of the body being formed from the insert end through the internal opposite end.

14. The golf club assembly as set forth in claim 11, which further comprises:

a flange formed laterally and outwardly on the body in a plane which includes the tip-insert end of the opening of the body.

* * * * *